US011374322B2

(12) United States Patent
Asaf et al.

(10) Patent No.: US 11,374,322 B2
(45) Date of Patent: Jun. 28, 2022

(54) PERPENDICULAR END FIRE ANTENNAS

(71) Applicant: INTEL CORPORATION, Santa Clara, CA (US)

(72) Inventors: Omer Asaf, Oranit (IL); Sidharth Dalmia, Portland, OR (US); Trang Thai, Hillsboro, OR (US); Josef Hagn, Munich (DE); Richard S. Perry, Portland, OR (US); Jonathan C. Jensen, Portland, OR (US); Raanan Sover, Haifa (IL)

(73) Assignee: Intel Corporation, Santa Clara, CA (US)

( * ) Notice: Subject to any disclaimer, the term of this patent is extended or adjusted under 35 U.S.C. 154(b) by 235 days.

(21) Appl. No.: 16/643,722

(22) PCT Filed: Sep. 30, 2017

(86) PCT No.: PCT/US2017/054662

§ 371 (c)(1),
(2) Date: Mar. 2, 2020

(87) PCT Pub. No.: WO2019/066980

PCT Pub. Date: Apr. 4, 2019

(65) Prior Publication Data

US 2020/0203834 A1 Jun. 25, 2020

(51) Int. Cl.

| | |
|---|---|
| ***H01Q 1/24*** | (2006.01) |
| ***H01Q 9/04*** | (2006.01) |
| ***H01Q 13/06*** | (2006.01) |

(52) U.S. Cl.

CPC ..... *H01Q 9/0407* (2013.01); *H01Q 1/243* (2013.01); *H01Q 13/06* (2013.01)

(58) Field of Classification Search

CPC ..... H01Q 13/06; H01Q 1/243; H01Q 9/0407
See application file for complete search history.

(56) References Cited

U.S. PATENT DOCUMENTS

| | | | |
|---|---|---|---|
| 9,225,058 | B2 | 12/2015 | DeVries et al. |
| 2013/0162488 | A1 | 6/2013 | Onaka et al. |
| 2014/0266973 | A1 | 9/2014 | DeVries et al. |
| 2014/0032956 | A1 | 11/2014 | Kikuchi et al. |

FOREIGN PATENT DOCUMENTS

| | | | |
|---|---|---|---|
| JP | H07203514 | A | 8/1995 |
| JP | 5166070 | B2 | 3/2013 |
| JP | 5413921 | B2 | 2/2014 |
| JP | 572571 | B2 | 5/2015 |

OTHER PUBLICATIONS

International Search Report for related PCT Application PCT/US2017/054662 dated Jun. 29, 2018, 3 pages.

*Primary Examiner* — Graham P Smith
(74) *Attorney, Agent, or Firm* — Banner & Witcoff Ltd.

(57) ABSTRACT

Techniques for fabricating end-fire antennas are described. An example of an electronic device with an end-fire antenna includes a housing of the electronic device, and a circuit board comprising electronic components of the mobile electronic device. The circuit board is parallel with the major plane of the housing. The electronic device includes an antenna coupled to the circuit board. At least a portion of the antenna is oriented perpendicular to the first circuit board to generate a radiation pattern with an amplitude that is greater in the end-fire direction compared to the broadside direction.

10 Claims, 17 Drawing Sheets

400

800

1200

1300

1400

1500

PERPENDICULAR END FIRE ANTENNAS

CROSS REFERENCE TO RELATED APPLICATIONS

Pursuant to 35 U.S.C. § 371, this application is the United States National Stage Application of International Patent Application No. PCT/US2017/054662, filed on Sep. 30, 2017, the contents of which are incorporated by reference as if set forth in their entirety herein.

TECHNICAL FIELD

This disclosure relates generally to perpendicular end fire antennas for electronic devices. More specifically, this disclosure relates to perpendicular end fire antennas for handheld electronic devices such as smart phones, tablet PCs, and the like.

BACKGROUND

The number of integrated wireless technologies included in mobile computing devices is increasing. These wireless technologies include, but are not limited to, WIFI, WiGig, mmWave, and Wireless Wide Area Network (WWAN) technologies such as Long-Term Evolution (LTE). The small size and the limited battery power available in such devices presents challenges when incorporating several antennas with suitable performance characteristics.

BRIEF DESCRIPTION OF DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DETAILED DESCRIPTION

The subject matter disclosed herein relates to techniques for incorporating antennas into electronic devices, including small portable user devices such as smart phones and tablet PCs, for example. Smart phones often use thin patch antennas that are disposed on the platform's Printed Circuit Board (PCB) in a parallel configuration, meaning that the plane of the radiating element is parallel to the plane of the platform's PCB. Technologies such as Wigig and 5G often rely on the use of a thin a PCB design as part as the integration into the platform. The overall antenna geometry of such parallel patch antenna designs results in radiation that is primarily in the broadside direction, i.e., perpendicular to the plane of the device's PCB. The radiation in the end fire direction, i.e., parallel to the plane of the device's PCB, is substantially lower compare to the broadside direction. For example, using a 350 micrometer (μm) thick stacked patch antenna operating at 60 Gigahertz (GHz), the difference of signal strength between broadside and end fire directions may be between 8 decibel isotropic (dBi) to 13 dBi.

The subject matter disclosed herein relates to various techniques for providing an antenna that is at least partially oriented in a direction perpendicular to the plane of the platform PCB. Disposing the antenna perpendicular to the plane of the platform PCB increases the antenna gain in the end fire direction, i.e., toward the sides of the device. In this way, the antenna gain can be increased in those directions more likely to correspond with other devices that that the device is attempting to communicate with, such as WiFi access points, cell towers, and others. Additionally, various embodiments of the present techniques provide an antenna that has a wide bandwidth while remaining compact in size. Various embodiments also provide an antenna with dual polarization.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other, i.e. near field coupling.

Figure 1:
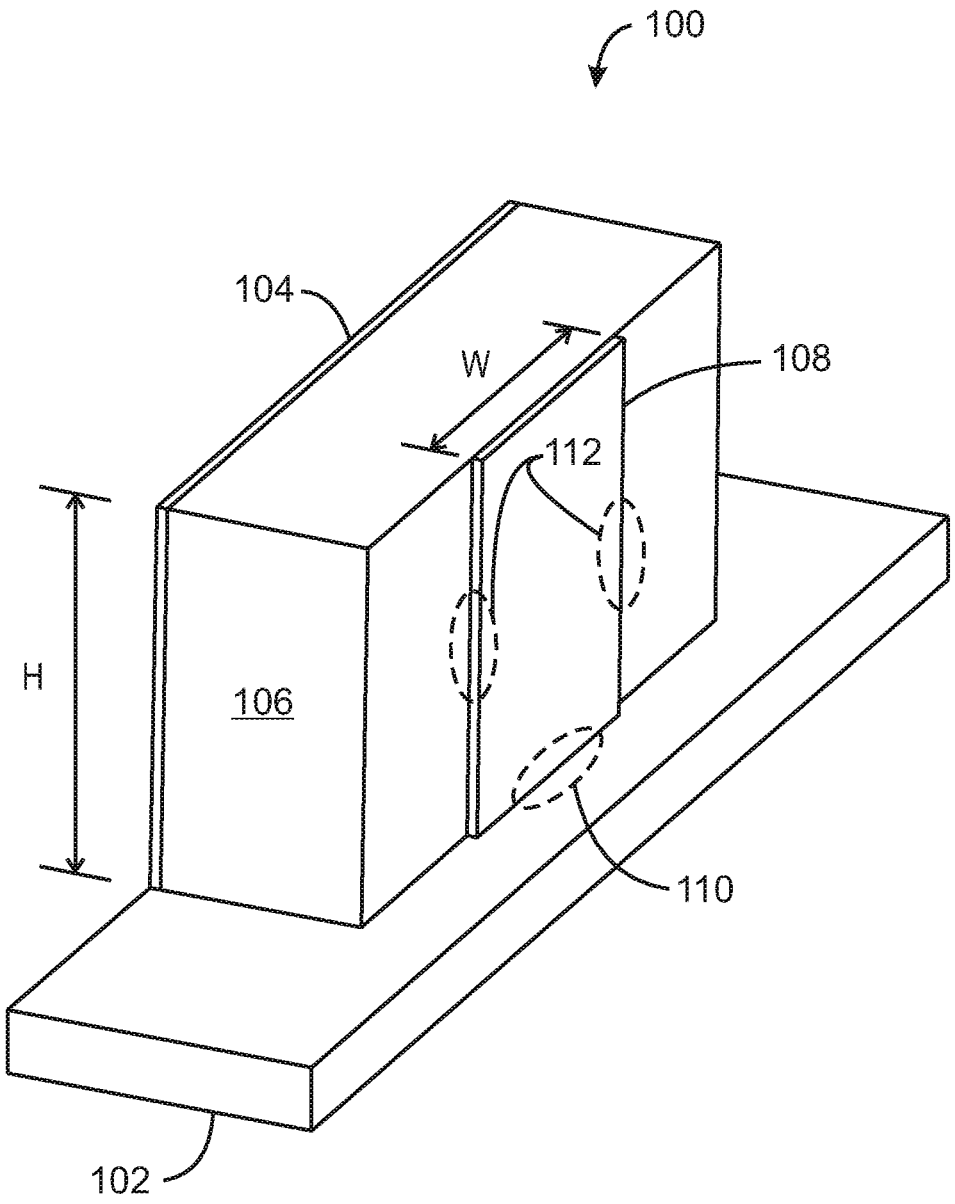
FIG. 1 is a perspective view showing an example of a perpendicular patch antenna.

FIG. 1 is a perspective view showing an example of a perpendicular patch antenna. As shown in FIG. 1, the patch antenna 100 is disposed on a PCB 102 and oriented perpendicular to the PCB 102, in other words, vertically. The PCB 102 is the main PCB of the device platform and include most of the device electronics, such as processor chips, memory chips, Radio Frequency (RF) front end modules, and the like. The PCB 102 can also be a separate module or daughter board that is connected to the device circuit board via connectors and cables. The plane of the PCB 102 is parallel with the face of the electronic device. As used herein, the term "horizontal" is used to refer to a line or plane that is parallel with the PCB 102 to which the patch antenna 100 is coupled, and the term vertical is used to refer to a line or plane that is at a right angle to the PCB 102.

The patch antenna 100 includes a ground layer 104, a dielectric layer 106, and a patch element 108. In this example, the dielectric layer 106 is a surface mount device and may be formed out of Bismaleimide-Triazine (BT) laminate. To keep the patch antenna small, the dielectric layer 106 may have a high permittivity and low dielectric loss. For example, the permittivity may be around 8 and dielectric loss around 0.0035. The ground layer 104 and the patch element 108 may be formed by edge plating the sides of the dielectric layer 106 with a conductive material. Both the ground layer 104 and the patch element 108 are oriented at right angles to the PCB 102 and extend vertically above the plane of the PCB 102.

The height of the patch antenna 100 above the PCB 102 is small enough to fit within the small space available within the device enclosure without interfering with other components. For example, the vertical height, H, may be approximately 1 millimeter (mm) or smaller. In this example, the horizontal width, W, of the patch element is approximately 0.8 mm. It will be appreciated that the dimensions of the ground layer 104 and patch element 108 may be adjusted to fit the desired characteristics of a specific implementation, such as the radiation pattern, antenna impedance, resonant frequency, and the like. The perpendicular patch antenna shown in FIG. 1 exhibits approximately 8 to 13 dB higher gain in the end-fire direction compared to conventional, i.e., horizontal, PCB patch antennas. For example, the perpendicular patch antenna provides the maximum radiation in the end fire direction of approximately 4.8 dBi at 60 GHz for a single antenna element. The efficiency at 60 GHz is approximately 96 percent, with a bandwidth of approximately 5 percent.

The patch antenna may be fed by coupling a conductive feedline (not shown) to any portion of the patch element 108. The feedline may be coupled to any side of the patch element 108 depending on the desired polarization. Additionally, dual polarization may be achieved by coupling a pair of feedlines to perpendicular sides of the patch element. For example, dual polarization may be achieved by coupling a first feedline to the bottom horizontal side of the patch element 108, identified by circle 110, and coupling a second feedline to one of the vertical sides of the patch element 108, identified by circles 112. An example feed structure is described further in relation to FIG. 2.

Figure 2:
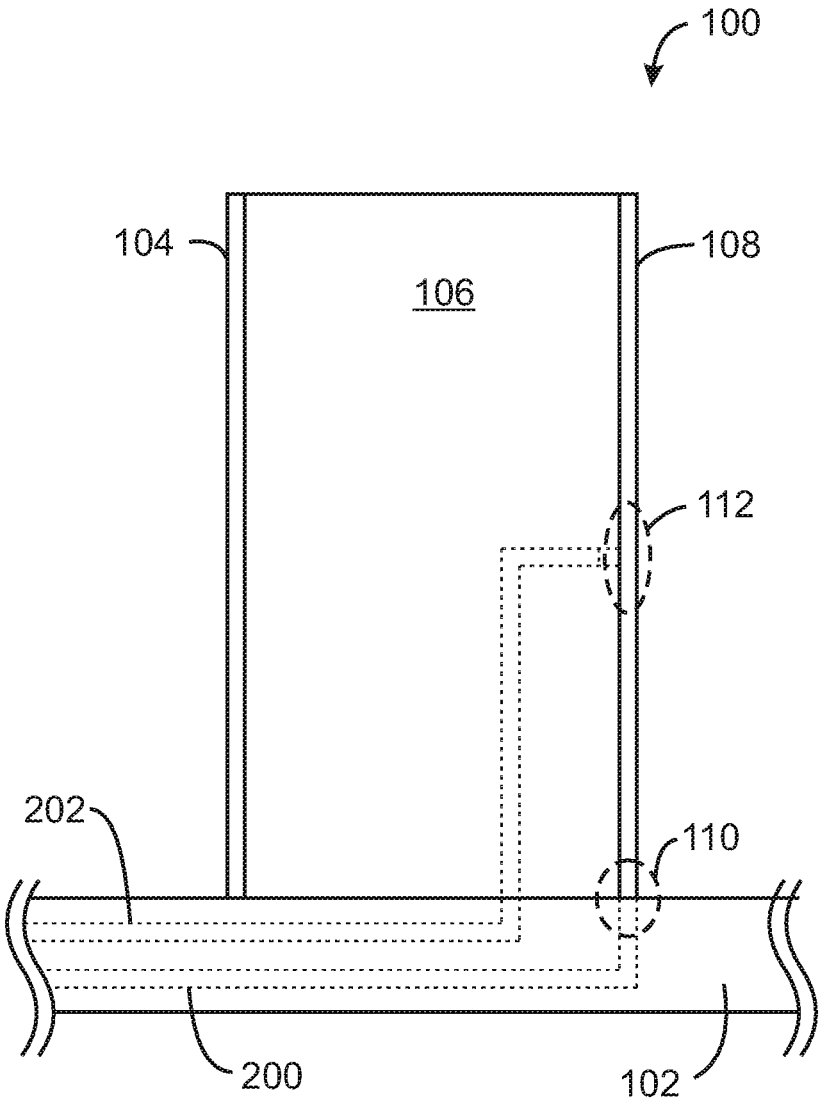
FIG. 2 is a side view of the patch antenna 100 shown in FIG. 1.

FIG. 2 is a side view of the patch antenna 100 shown in FIG. 1. FIG. 2 shows an example feed structure that can be used to implement dual polarization in the patch antenna 100. In this example, the feedlines 200 and 202, which can be a combination of microstrip, stripline, coplanar lines or substrate integrated waveguides, are disposed within the PCB 102 and couple the patch antenna 100 to respective RF transmitter and/or receiver circuits (not shown), such as a RF front-end module, transceivers, and the like. Feedline 200 couples to the bottom horizontal side 110 of the patch element 108. Feedline 202 includes a portion that extends vertically through a via in the dielectric layer 106 and couples to one of the vertical sides 112 of the patch antenna 108.

It will be appreciated that the feed structure shown in FIG. 2 is just one example of a technique for feeding the patch antenna, and that other feed structures are also possible. In some embodiments, the patch antenna 100 can have a single polarization, in which case one of the feedlines 200 or 202 can be eliminated.

Figure 3:
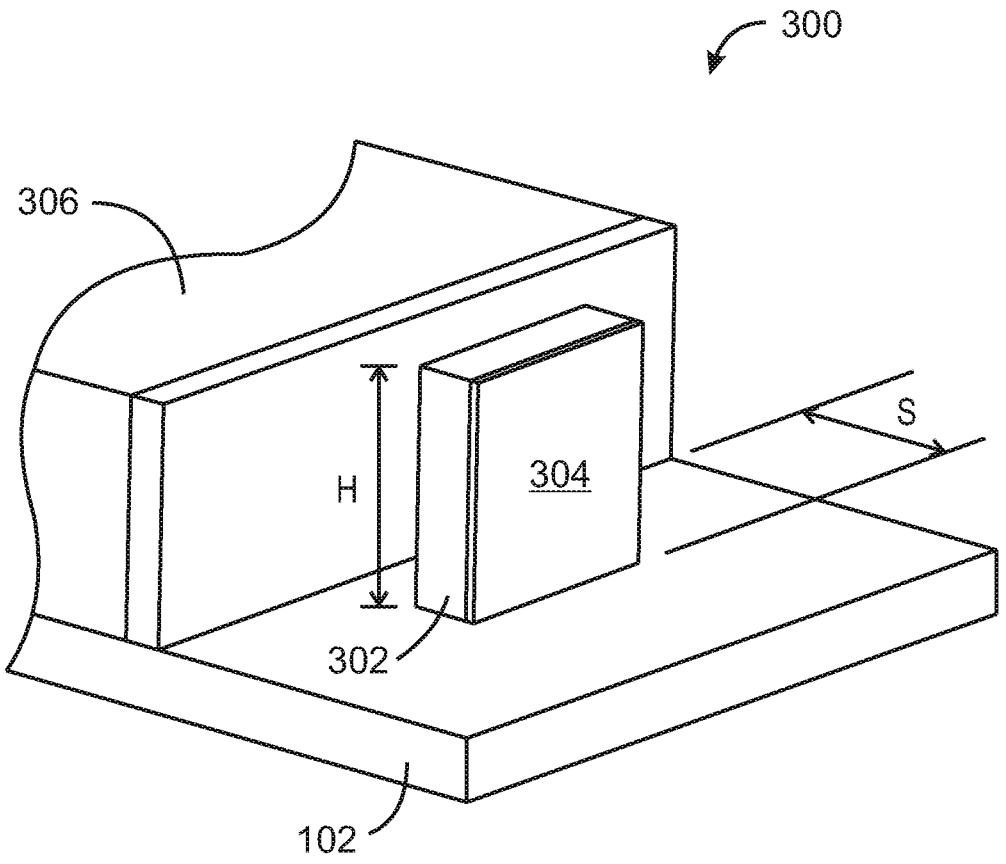
FIG. 3 is a perspective view showing another example of a perpendicular patch antenna.

FIG. 3 is a perspective view showing another example of a perpendicular patch antenna. The patch antenna 300 is similar to the patch antenna 100 of FIGS. 1 and 2, and includes the dielectric layer 302 and patch element 304. The dielectric layer 302 may be a surface mount device, and the patch element 304 may be formed using edge plating. As with the patch antenna 100 of FIGS. 1 and 2, the patch antenna 300 is disposed on a PCB 102 and oriented perpendicular to the PCB 102, such that the patch element 304 extends vertically above the PCB.

In the patch antenna 300, an electromagnetic (EM) shield 306 is used to as a ground element of the patch antenna 300. The EM shield 306 may be a conductive shell used to surround electronics and cables to protect against incoming or outgoing emissions of electromagnetic frequencies (EMF). For the sake of simplicity, only a portion of the EM shield 306 is shown in FIG. 3. However, the EM shield 306 may be configured to at least partially encompass and enclose a number of electronic components disposed on the PCB 102, such as processors, capacitors, inductors, and the like. Using the EM shield 306 as the ground layer improves the antenna bandwidth compared to the patch antenna shown in FIGS. 1 and 2. The patch antenna 300 may be fed by coupling on or more feedlines to the patch element 304 as described above in relation to FIGS. 1 and 2.

An example embodiment of the patch antenna 300 may have a height, H, of approximately 3.0 mm, with a spacing, S, between the patch element 304 and the EM shield 306 of approximately 1.0 mm. These dimensions make the patch antenna 300 suitable for operation at 28.5 GHz, which is used in 5G applications. Using these dimensions, the patch antenna 300 exhibits a bandwidth of approximately 13 percent, and the radiation efficiency at 28.5 GHz is approximately 94 percent. It will be appreciated that the dimensions of the patch element 304 and spacing, S, may be adjusted to fit the desired characteristics of a specific implementation, such as the radiation pattern, antenna impedance, resonant frequency, and the like.

Figure 4:
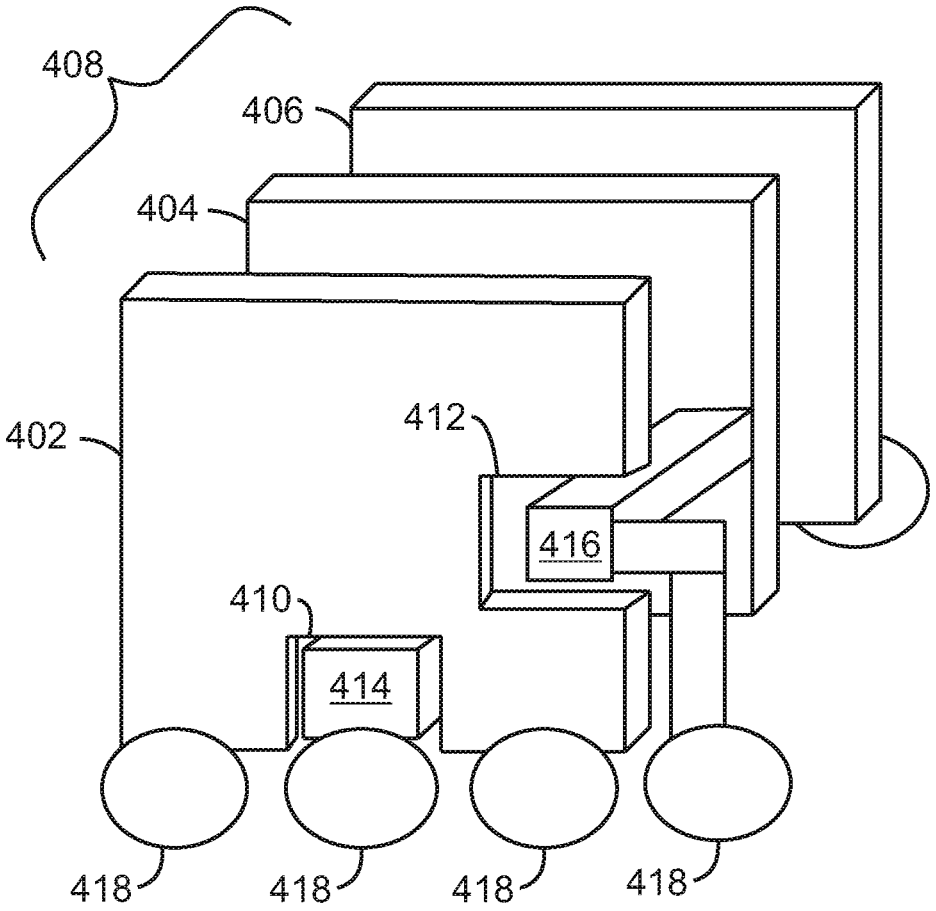
FIG. 4 is a perspective view showing another example of a perpendicular patch antenna.

FIG. 4 a perspective view showing another example of a perpendicular patch antenna. The patch antenna 400 includes a ground layer 402, a patch element 404, and a parasitic element 406. For the sake of clarity, only the conductive layers of the patch antenna 400 are shown. However, in an actual embodiment, the conductive layers 402, 404, and 406 will be separated by dielectric layers (not shown).

The patch antenna 400 may be fabricated in any type of multiple layer circuit board, referred to herein as the circuit board substrate 408. The circuit board substrate 408 enables the patch antenna 400 to be formed using standard PCB design techniques to create conductive traces, pads, vias, and other features. For example, the conductive layers 402, 404, and 406 may be etched from metal sheets laminated onto a non-conductive dielectric substrate. The electrical connections to the patch element 404 may be formed by creating via holes in the circuit board substrate. The via holes may be lined with a conductive material through electroplating, or may lined with a conductive tube or a rivet, for example.

In the example shown in FIG. 4, the ground layer 402 is disposed on an outer surface of the circuit board substrate 408. The ground layer 402 includes a pair of recesses 410, 412 surrounding contact pads 414, 416, which are conductively coupled to the patch element 404 through a via. The patch antenna 400 shown in FIG. 4 is a dual polarization antenna. Accordingly, contact pad 414 is coupled to the bottom of the patch element 404 for vertical polarization, and the contact pad 416 is coupled to the side of the patch element 404 for horizontal polarization. In a single polarization embodiment, one of the contact pads 414 or 416 and the corresponding via may be eliminated.

The parasitic element 406 is a passive element and does not have any conductive signal connections. The spacing and size of the parasitic element may be selected to adjust the electrical characteristics of the antenna, such as directivity.

After the patch antenna 400 is fabricated, it can be flipped vertically and mounted on another PCB, such as the PCB 102 shown in FIGS. 1-3. The patch antenna 400 may be electrically coupled to contact pads on the PCB 102 via a surface mounting technique known as Ball Grid Array (BGA). Solder balls may be disposed at the bottom edge ground layer 402 for coupling the patch antenna 400 to contact pads on the PCB 102. In addition to providing electrical contacts, the solder balls also secure the patch antenna 400 to the PCB 102 in the vertical orientation. A conductive signal trace 420 on the surface of the circuit board substrate 408 couples the contact pad 416 to its respective solder ball 418.

In an example embodiment, the width of the ground layer 402, patch element 404, and parasitic layer 406 is approximately 1.6 to 1.9 mm, which apply to operation frequency range of 40 GHz. The overall height of the patch antenna 400, including the dielectric layers, may be approximately 2.2 mm, and the depth of the patch antenna 400 may be approximately 1.5 mm. The spacing between solder balls 418 may be approximately 0.5 mm, and the diameter of the solder balls may be approximately 0.25 mm. The dimensions above are provided as an example. Other dimensions can be used, depending on the desired electrical characteristics of the patch antenna 400.

Figure 5:
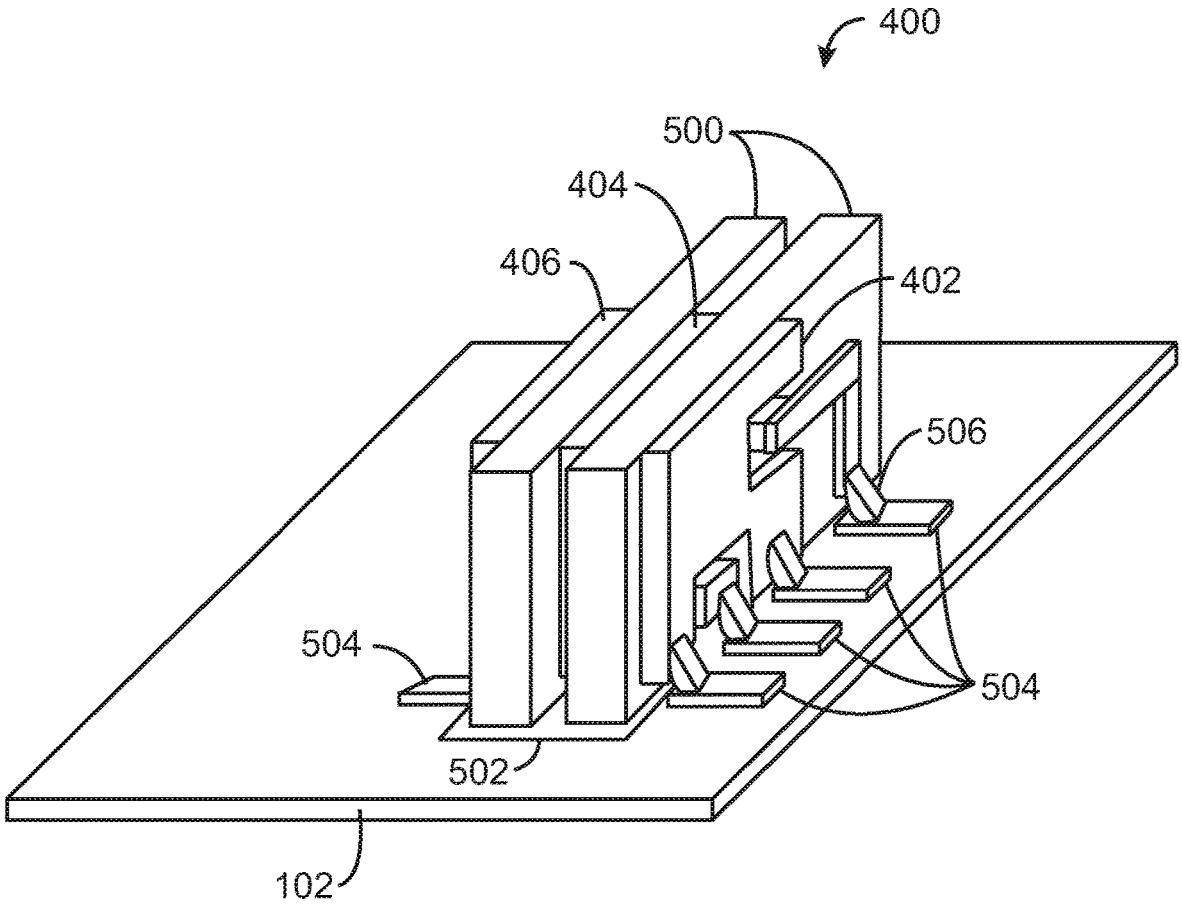
FIG. 5 is a perspective view of the patch antenna 400 shown in FIG. 4.

FIG. 5 is a perspective view of the patch antenna 400 shown in FIG. 4. In FIG. 5, the patch antenna 400 is shown disposed on the PCB 102. Furthermore, this view shows the dielectric layers 500 separating the ground layer 402, the patch element 404, and the parasitic element 406. In some embodiments, the PCB 102 includes a recess 502 that receives the patch antenna 400 and facilitates alignment of the patch antenna 400 into the correct position on the PCB 102.

To couple the patch antenna 400 to the PCB, the patch antenna 400 may be positioned directly on top of PCB 102 directly over exposed laminate without a solder mask. The solder balls 418 (FIG. 4) sit over exposed metal contact pads 504 that have solder paste printed on them. The arrangement may then be heated to melt the solder balls. After heating, the solder balls collapse to form fillets 506.

Figure 6:
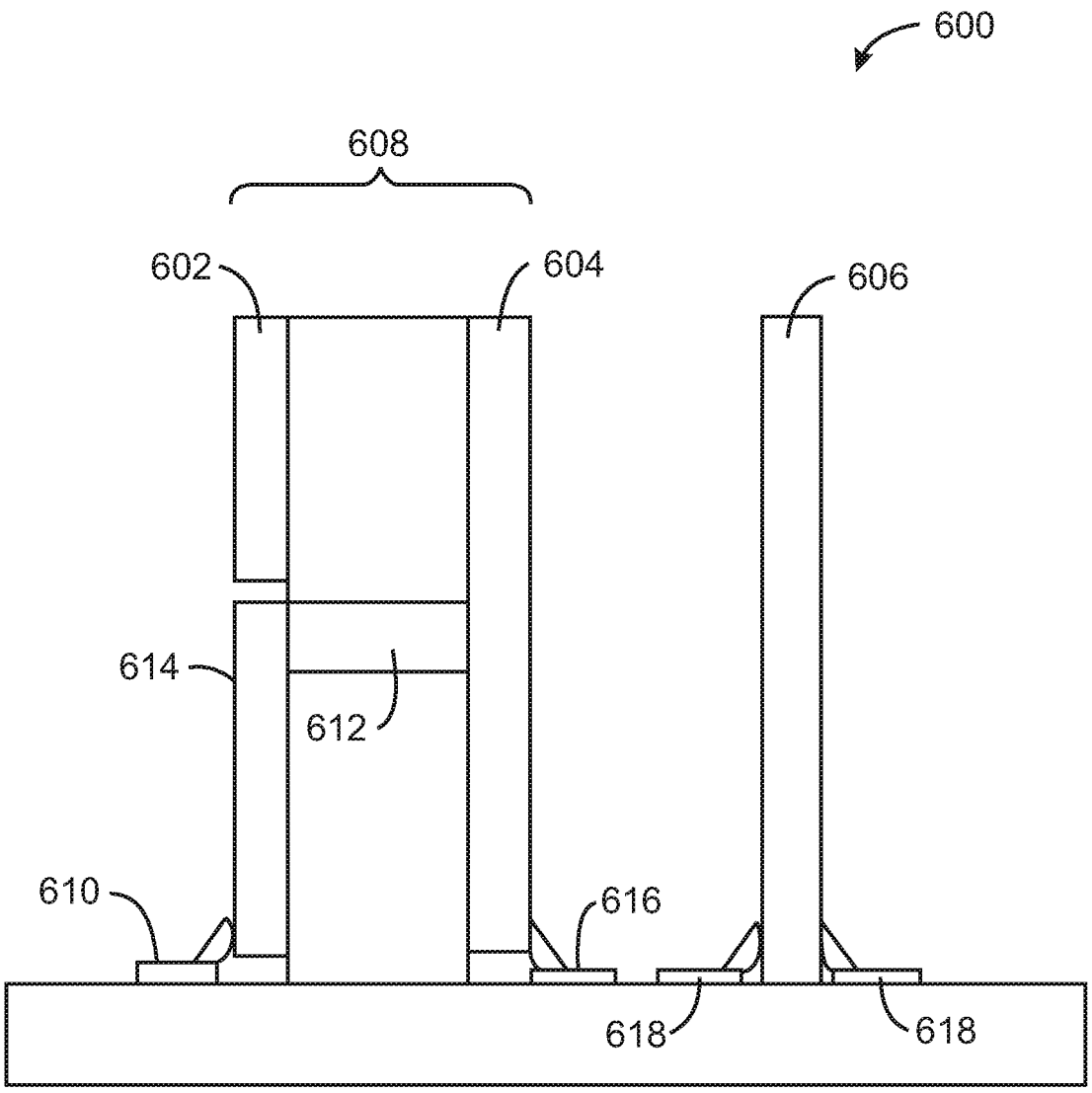
FIG. 6 is a side view of another example of a perpendicular patch antenna.

FIG. 6 is a side view of another example of a perpendicular patch antenna. The patch antenna 600 is similar to the patch antenna 400 described in relation to FIGS. 4 and 5. The patch antenna 600 includes a ground layer 602, a patch element 604, and a parasitic element 606. However, in this example, the patch element 604 and the parasitic element 606 are separated by an air gap. The air gap improves the performance of the patch antenna 600 in terms of bandwidth compared to the patch antenna 400 of FIGS. 4 and 5, which includes a dielectric material between the patch element 604 and the parasitic element 606. This feature introduces another degree of freedom for antenna design of the vertically mounted patch.

In this example, the ground layer 602 and the patch element 604 may be formed on opposite sides of a single layer circuit board 608. As in the patch antenna 400 of FIGS. 4 and 5, the patch element 604 is coupled to a contact pad 610 through a feed structure that includes a conductive via 612 and a signal trace 614 on the surface of the circuit board. In this view, only the horizontal polarization is shown. However, the patch antenna 600 can also include feed structures for vertical polarization in addition to or in place of the horizontal polarization feed structures. In some examples, the vertical polarization feed can be implemented through a via, as described in FIGS. 4 and 5, or through the contact pad 616. In some embodiments, the contact pad 616 is floating and is used merely for physical support.

The circuit board 608 and the parasitic element 606 are coupled to the PCB 102 separately using a ball grid array mounting technique. The parasitic element 606 is soldered to the contact pads 618 to provide physical support for the parasitic element 606. The contact pads 618 are floating and do not connect to any signal lines.

Figure 7A:
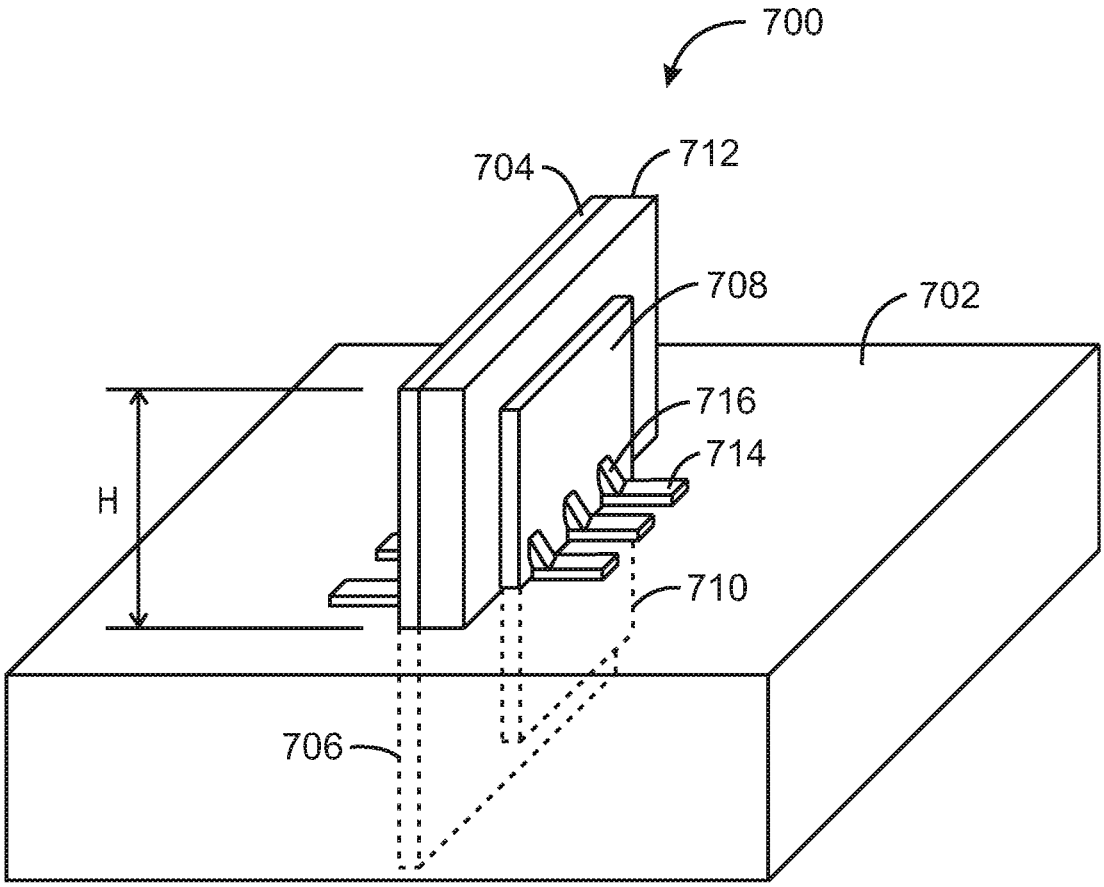
FIG. 7A is a perspective view showing another example of a perpendicular patch antenna.

FIG. 7A is a perspective view showing another example of a perpendicular patch antenna. The patch antenna 700 is similar to the patch antenna shown in FIGS. 1 and 2. However, in this example, the patch antenna 700 is partly embedded within the substrate 702. The patch antenna 700 includes a ground layer, which is made up of a surface portion 704 and an embedded portion 706. The patch antenna 700 also includes a patch element which is made up of a surface portion 708 and an embedded portion 710. The ground layer surface portion 704 and the patch element surface portion 708 are separated by a dielectric layer 712. Together, the ground layer surface portion 704 and the patch element surface portion 708 and dielectric layer 712 may be formed as a surface mount device and coupled to the surface of the substrate 702 using BGA surface mounting as described above. Accordingly, the ground layer surface portion 704 and the patch element surface portion 708 are coupled to contact pads 714 by fillets 716. In some embodiments, the contact pads 714 are used only for physical supports and are floating, i.e., not coupled to signal lines. Additionally, the ground layer surface portion 704 and the patch element surface portion 708 may be formed by edge plating the sides of the dielectric layer 712 with a conductive material.

The substrate 702 may be a multiple layer printed circuit board, which includes signal traces for coupling the antenna elements to the platform circuitry such as RF front end modules. In some embodiments, the ground layer embedded portion 706 and the patch element embedded portion 710 are formed using a mesh of metalized through vias and signal traces. An example mesh is shown in FIG. 7B.

In this example, one or more feedlines (not shown) may be embedded within the substrate 702 to couple the patch antenna 700 to respective RF transmitter and/or receiver circuits. The feedlines may be coupled to any part of the patch element embedded portion 710 to provide a vertical polarization, horizontal polarization, or circular polarization. Embedding a portion of the patch element within the substrate 702 provides the design flexibility to easily couple the feedlines to any part of the patch element embedded portion 710 designated as a feed point.

The arrangement shown in FIG. 7A enables the height of the vertical patch antenna 700 above the substrate 702 to be reduced compared to the patch antennas shown in FIGS. 1-6 while still maintaining similar electrical characteristics. In some examples, the height, H, of the patch antenna 700 above the substrate 702 may be approximately 0.5 to 1.5 mm for operating frequencies as low as 25 GHz-30 GHz. The height may be lower for higher frequencies.

Figure 7B:
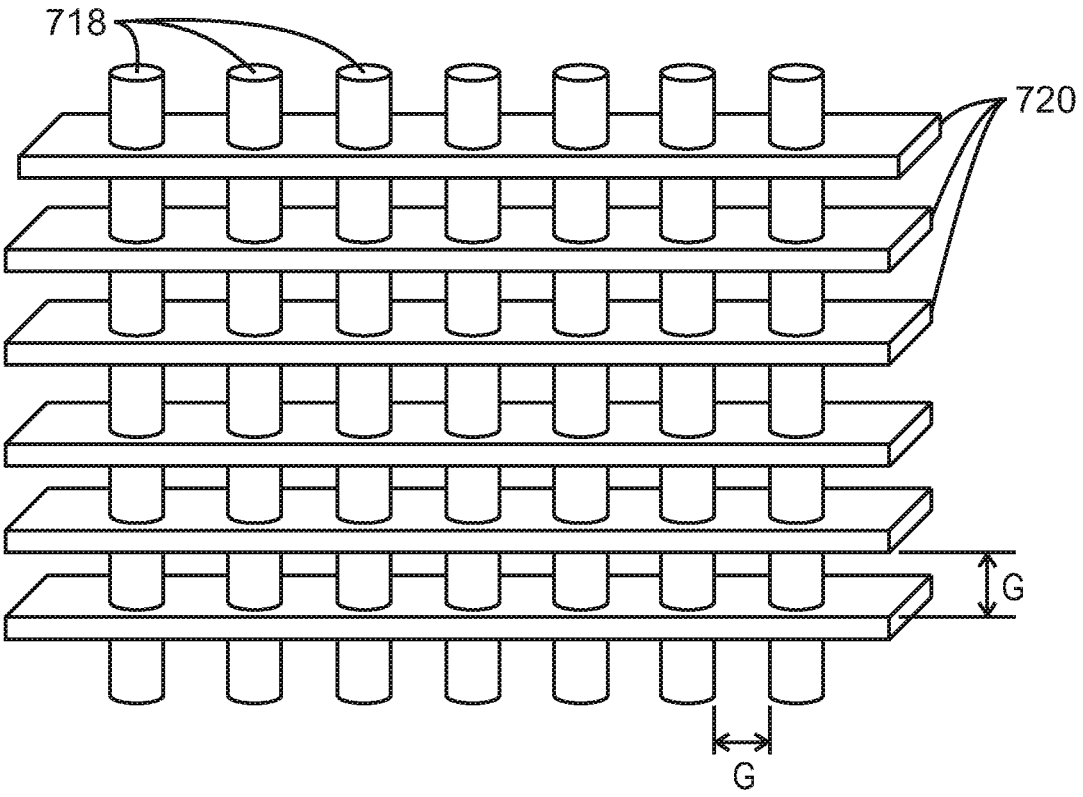
FIG. 7B is an illustration of a portion of the metalized mesh used to form the embedded portions of the patch antenna shown in FIG. 7A

FIG. 7B is an illustration of a portion of the metalized mesh used to form the embedded portions of the patch antenna shown in FIG. 7A. Vertical portions of the mesh are formed by metalized through vias 718. Horizontal portions of the mesh are formed by signal traces 720 such as stripline traces. The mesh density is high enough that the mesh behaves electrically like a solid metal plane at millimeter wave frequencies, i.e., frequencies above 30 GHz. For example, the gaps, G, between the vias and between the signal traces may be approximately 80 to 200 microns. Gaps in the mesh can enable feedlines to pass through the mesh, which simplifies the routing of the feedlines. It will be appreciated that the mesh shown in FIG. 7B is only a portion of the mesh used to from the ground layer embedded portion 706 and the patch element embedded portion 710. In actual implementation, the ground layer embedded portion 706 and the patch element embedded portion 710 can include additional vias 718 and additional signal traces 720 compared to what is shown in FIG. 7B.

Figure 8:
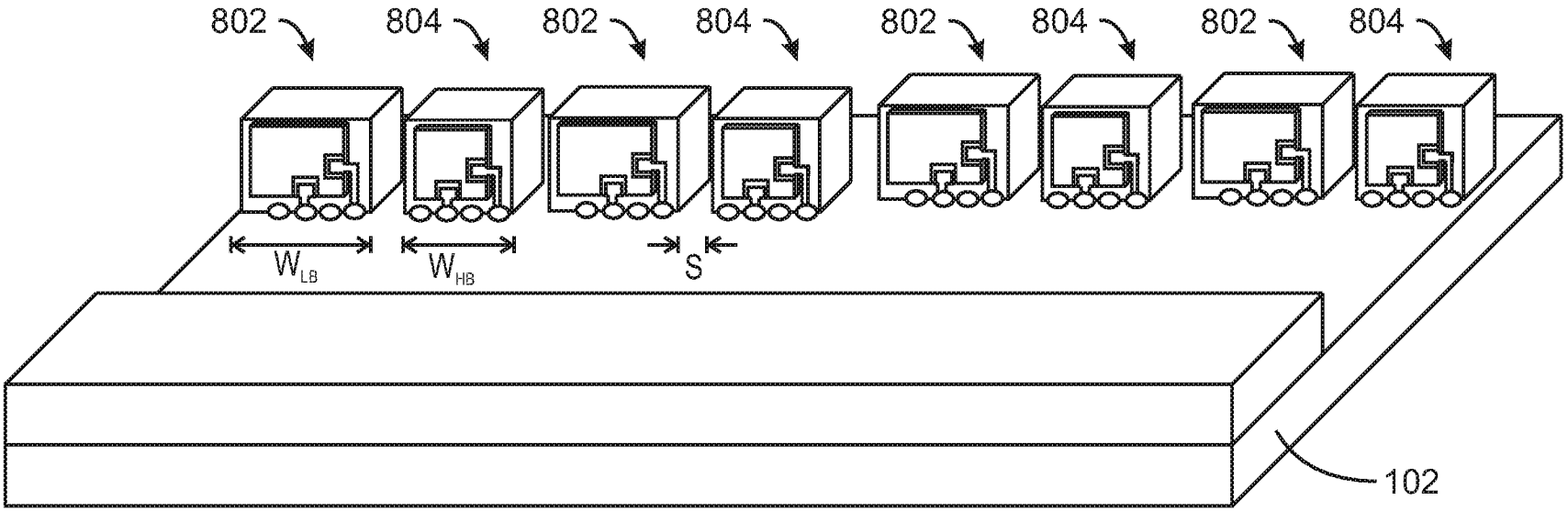
FIG. 8 is a perspective view of an antenna system with multiple patch antennas.

FIG. 8 is a perspective view of an antenna system with multiple patch antennas. The antenna system 800 includes patch antennas 802, which may be any of the patch antennas describe above in relation to FIGS. 1-8. Additionally, the patch antennas may be dual polarized, horizontally polarized, vertically polarized, circularly polarized, or a combination thereof.

The patch antennas 802 can be configured to cover multiple frequency ranges and can be configure as a Multiple-Input Multiple-Output (MIMO) antenna system. In some embodiments, the antenna system can be used to cover the low band (LB) and high band (HB) frequency ranges for Enhanced Data rates for GSM Evolution (EDGE). In EDGE, the low band covers a frequency range from 24 GHz to 33 GHz and the high band covers a frequency range from 37 GHz-43 GHz. The antenna system 800 includes four LB patch antennas and four HB patch antennas arranged in an alternating pattern.

The four LB antennas and four HB antennas may be configured in any suitable manner, and may be reconfigured on the fly during operation. One or more of the four LB antennas may be grouped together and configured as a phased array. Additionally, one or more of the four LB antennas may be configured as a separate transmitting and/or receiving channel. For example, two of the LB antennas may be grouped together as a first phase array, and the remaining two LB antennas may be configured as a second phased array. Each phased array may be configured to service a different channel, or one phased array may be used as a transmitter, while the other phased array may be used as a receiver. Any number of other possible combinations are possible, and also apply to the four HB antennas.

The width of the LB antennas, $W_{LB}$, may be approximately 2.7 mm, the width of the HB antennas $W_{HB}$ may be approximately 2.2 mm, and the spacing, S, between each antenna may be approximately 0.2 mm. Thus, the distance between each of the patches is approximately 5.3 mm, and the overall width of the antenna system 800 may be approximately 22 mm. The antenna spacing between the patch antennas equates to 0.5 wavelength at 30 GHz. Across the entire LB and HB frequency bands (24 to 43 GHz) the wavelength spacing varies from 0.4 to 0.7 wavelengths. This provides a suitable tradeoff between antenna gain and beamforming ability across the range of frequencies.

The patch antennas are disposed on a PCB 102 with feedlines coupling the patch antennas to respective RF transmitter and receiver circuits. The transmitter and receiver circuits may be enclosed with an EM shield 806 along with various additional electronic components disposed on the PCB 102.

Figure 9A:
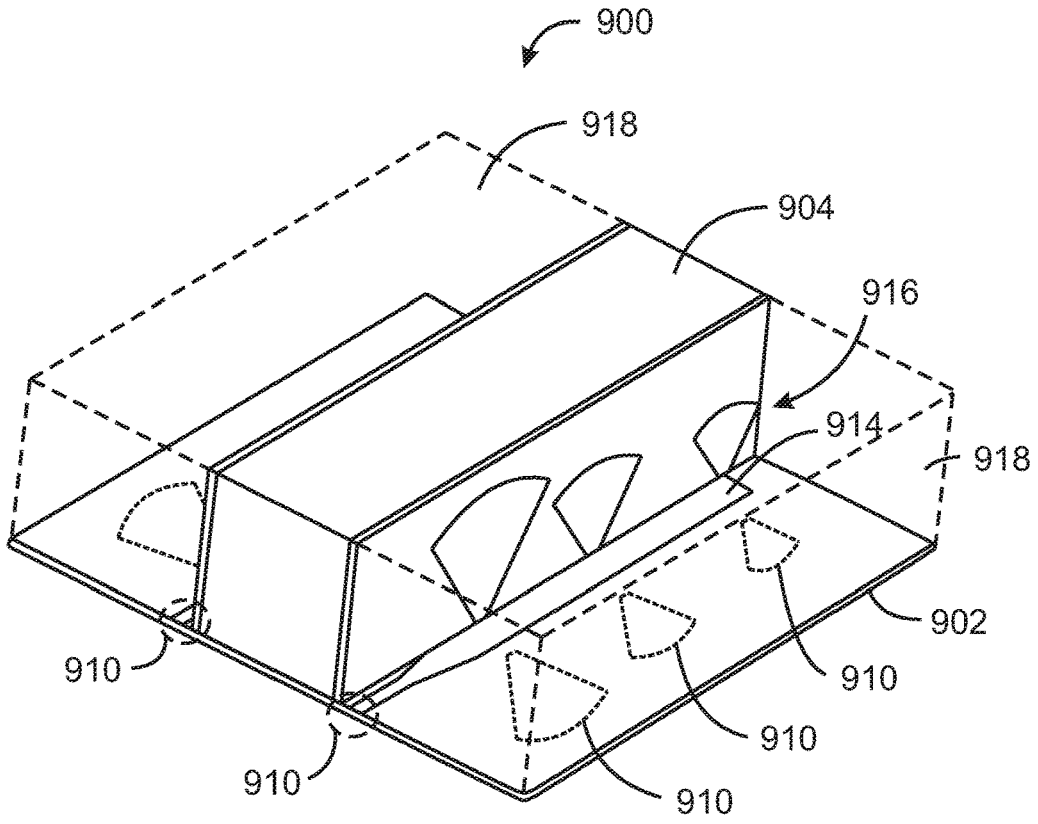
FIGS. 9A and 9B are perspective views of another example of a perpendicular end-fire antenna.
Figure 9B:
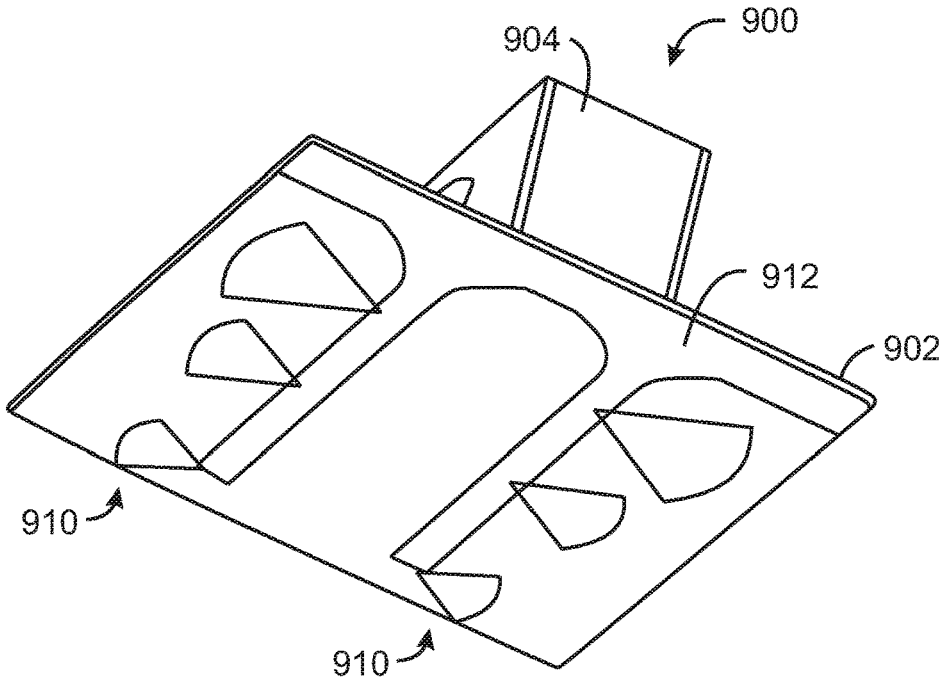

FIGS. 9A and 9B are perspective views of another example of a perpendicular end-fire antenna. FIG. 9A shows a top perspective view, and FIG. 9B shows a bottom perspective view. In this example, the perpendicular antenna 900 includes a ground portion disposed on planar substrate 902 and a signal portion disposed on a vertical substrate 904. In some embodiments, the planar substrate 902 may be a printed circuit board PCB and the vertical substrate 904 may be rectangular block of dielectric material surface mounted on the top side of the planar substrate 902.

The perpendicular antenna 902 is two port structure and includes a first signal port 906 and second signal port 908. The first signal port 906 and second signal port 908 may be used for two different polarizations of the same signal. The ground portion includes two sets of three mirrored bowties 910 printed on the bottom side of the planar substrate 902 and in contact with a ground plane 912. The signal portion includes two microstrip lines that transition into parallel striplines, each excited by a separate port, printed on the top side of the planar substrate 902. The signal portion also consists of two sets of three bowties 916 printed on opposite sides of a rectangular vertical substrate 904. The vertical substrate 904 may be soldered to the top of the planar substrate 902 to make electrical contacts between the bowties 916 and the microstrip lines 914 to form two active antenna elements. In some examples, two dielectric portions 918, shown with dotted lines, can be mechanically secured on either side of the vertical substrate 904 by filling the surrounding volume with plastic overmold.

The resulting antenna 900 is dual polarized and includes two periodic bowtie arrays, each of which includes a radiating element in the vertical plane and a corresponding radiating element in the horizontal plane. The overall height of the antenna 900 in the vertical direction is about half the width of a fully planar bowtie antenna. This configuration also introduces a vertical component to the electric field and thus effectively turns the co-polarization vector of the bowtie arrays to 45 degrees off the planar face. Consequently, the two orthogonal polarizations are realized in the plane that is normal to the end-fire radiation, which is the propagation direction of the antenna. This feature allows optimum MIMO communication channel based on polarization diversity to be established in the end-fire direction of the device. In some embodiments, the total size of the antenna area in the horizontal plane may be approximately 5.5×6.5 square mm to 7.0×7.5 square mm and the vertical height thickness may be between 1.9 mm to 2.2 mm.

The field distribution of the resonant modes is linear on the bowtie wings. As one side of the log periodic bowtie array (with respect to one excitation port) is folded vertically, the E-field vector of this side is oriented vertically and thus forms a combined E-field vector 45 degrees from the surface of the planar substrate. Furthermore, the polarizations of the two bowtie arrays are at 90 degree to one another. Because the antenna 900 exhibits a high isolation between these two polarizations, its orthogonal E-field radiation is low, and the far field isolation between the cross-polarization and co-polarization may be approximately 20 dB or higher. The realized gain of the cross-polarization at 28 GHz for each port is 5.5 dB accounting for all losses (both impedance mismatch and radiation efficiency).

Each set of bowties may be spaced and sized with a log periodic relationship. This increases the bandwidth of the antenna structure. In the example described herein, the antenna can operate from the low band (24 GHz-33 GHz) to the high band (37 GHz-43 GHz) with approximately a 9 to 10 dB return loss, and a bandwidth greater than 50 percent. The coupling level between port 1 and port 2 are symmetrical exhibit a high isolation level of around 20 dB across both the low band (24 GHz-33 GHz) and high band (37 GHz-43 GHz).

This dual polarization 2-port bowtie antenna can be fabricated in low cost, high yield manufacturing processes. The microstrip lines 914, ground plane 912 and bowties illustrated in FIG. 9B may be printed on horizontal substrate 902, which may be a dielectric laminate. In some embodiments, the laminate is a rigid high frequency substrate with a dielectric value of between 2 to 6 and thickness from 80 μm to 200 μm. The signal layer bowties 916 may be printed on the vertical substrate 904, which may be another thick layer of dielectric substrate which can be the same or different material as the first laminate. The bowties 916 may be printed symmetrically on both sides of the block of the vertical substrate 904. The thickness of the block is the separation distance between the two metal layers of the bowties 916. In some embodiments, the thickness of the block may be between 1.1 mm and 2.1 mm. This thickness can be realized in fabrication by stacking multiple laminates and applying cutting after the metal features are printed on the laminates. The vertical substrate assembly and the horizontal substrate assembly are then soldered together along the partially microstrip partially parallel strip lines 914 and, optionally, secured by the plastic overmold fill-in 918 as illustrated by the dotted lines.

The example described above uses bowtie antenna elements. However, the various other antenna types may be used in place of bowties. For example, the antenna elements may be linear antenna types, such as dipoles, biconical antennas, and antipodal antennas, or traveling wave antenna types, such as tapered slots, Vivaldi antennas, open slot antennas, or any antenna type that has symmetry about its excitation source.

Figure 10:
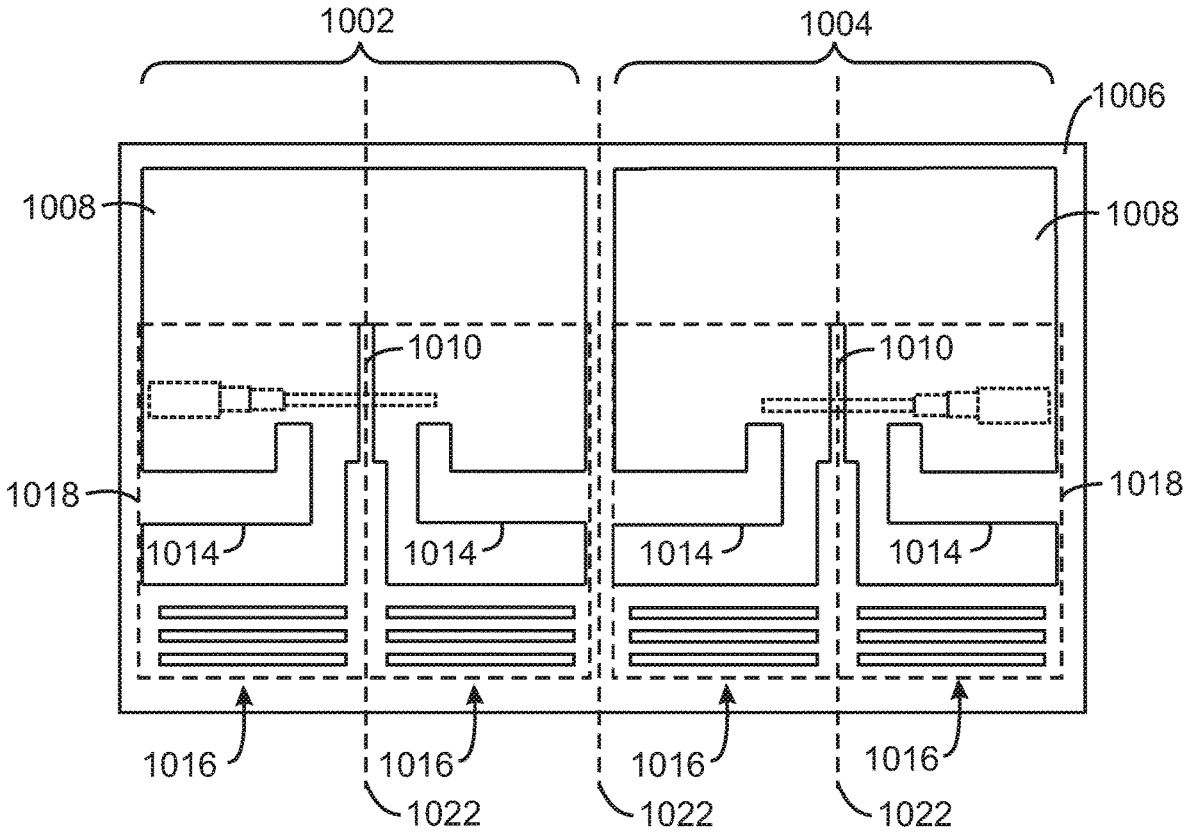
FIG. 10 is a top view of a two-port antenna structure with two open slot antennas.

FIG. 10 is a top view of a two-port antenna structure with two open slot antennas. The antenna structure 1000 includes a first open slot antenna 1002 and a second open slot antenna 1004. Each open slot antenna is formed on a semi-flexible, semi-rigid circuit substrate 1006. For example, the circuit substrate 1006 can include a flexible laminate core embedded in rigid substrate layers. The metal layers of each open slot antenna (the raised areas) may be printed on the surface of the flexible laminate.

Each open slot antenna includes a ground plane 1008 with a slot 1010 on one side of the circuit substrate and a microstrip signal line 1012 on the other side of the circuit substrate 1006 that serves as a feed structure. The microstrip signal line 1012 and slots 1010 can include impedance steps that enable wide-band impedance matching. The microstrip signal line 1012 excites the resonant modes of the open slot antenna via the stepped impedance slot lines. In another embodiment, the slot antenna can be fabricated in two separate laminate boards. The vertical portion of the slot can be fabricated as a separate multilayer board and assembled vertically to the horizontal board, whose assemble process is similar to the approach described previously for the bowtie antenna shown in FIGS. 9A and 9B.

Each open slot antenna can also include two L-shape slots 1014 that are formed the sides of the ground plane 1008. The L-shaped slots 1014 reduce the current paths along the side edges which contribute to the back radiation, thus enhancing the directivity of the antenna to end-fire direction. The L-shaped slots 1014 also improve the impedance matching for the low frequency band.

Each open slot antenna can also include two sets of parasitic directors 1016, which are placed on the same ground layer and positioned close to the open slot. In this example, three parasitic directors are shown. However, in an actual implementation, each antenna may include more or fewer parasitic directors, including 1, 2, 4, or more. The parasitic directors improve the directivity of the open slot in the end-fire direction and enhance matching for the high frequency band.

The overall area of each open slot antenna is designated as a "keep out" area, which is designated by the dashed boxes 1018. Additional components may be included in the circuit substrate outside of the keep out area. In some embodiments, the keep out area may be as small as 2.2 mm×3.2 mm for the frequency range of 24 to 45 GHz.

Figure 11A:
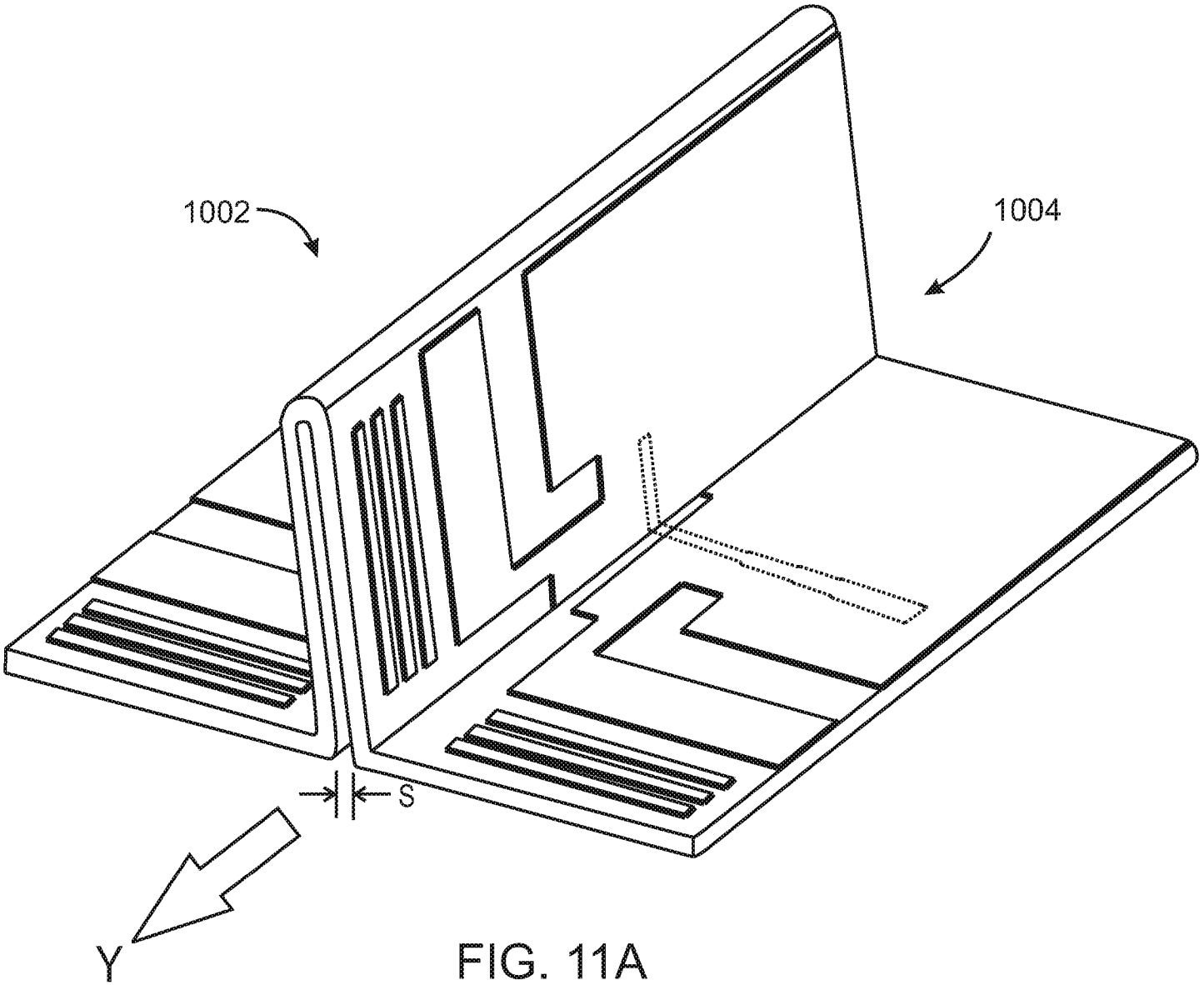
FIGS. 11A and 11B are perspective views of another example of a perpendicular end-fire antenna created by folding the antenna structure shown in FIG. 10.
Figure 11B:
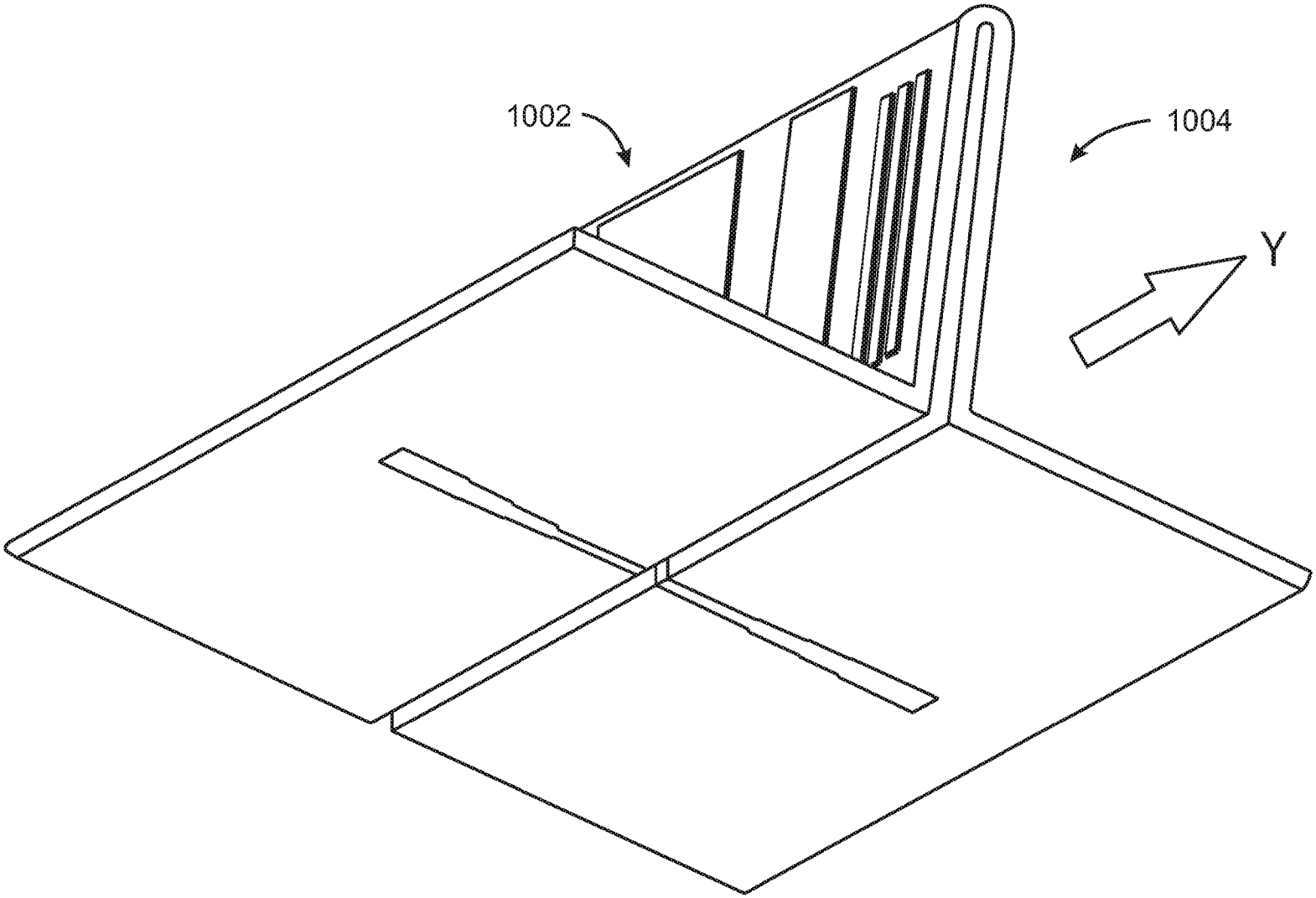

In the semi-rigid substrate approach, after the metal layers are formed, the antenna structure is folded along the folds indicated by the dotted lines to create the two-port perpendicular end-fire antenna show in FIGS. 11A and 11B. Specifically, the circuit board is folded downward about the center fold axis 1020, and the two side portions are folded upward about the two side fold axes 1022. This results in a two-port perpendicular antenna with two folded open slot antennas as shown in FIGS. 11A and 11B.

FIGS. 11A and 11B are perspective views of another example of a perpendicular end-fire antenna created by folding the antenna structure shown in FIG. 10. FIG. 10A shows a top perspective view, and FIG. 10B shows a bottom perspective view. As shown in FIGS. 11A and 11B, the two-port antenna includes two folded open slot antenna elements 1002 and 1006 arranged in a mirror configuration about the center folding axis to generate orthogonal E-field vectors. The spacing, S, between the antenna elements may be determined by the folding radius of the circuit board. In some example embodiments, the spacing, S, may be approximately 0.3 to 0.4 mm, which corresponds to an effective folding radius of 0.15 to 0.2 mm. The folded antenna structure may be disposed on a circuit board and held in place by pins.

The direction of signal propagation for this antenna is in the Y direction as indicated in the figures. The result is a two-port end-fire antenna that produces dual polarization with good port-to-port isolation while inhering most of the radiation characteristics of the planar version of the antennas.

Each open slot antenna includes a radiating element in the vertical plane and a corresponding radiating element in the horizontal plane. This configuration introduces a vertical component to the electric field and thus effectively turns the co-polarization vector of the open slot antennas 45 degrees off the planar face. Furthermore, the polarizations of the two open slot antennas are at 90 degree to one another. In some embodiments, the total size of the antenna area in the horizontal plane may be approximately 4.2×4.2 square mm to 7.5×7.5 square mm and the vertical height thickness may be between 1.5 mm to 2.2 mm. In some embodiment, using miniaturization techniques, and based on folding the slot, the size can be reduced to 4.2×3.7×1.5 mm for the operation frequency range of 24-45 GHz.

The vertical open slot antenna 1000 can operate at a frequency range from 26 GHz to 46 GHz with around a 9 to 10 dB return loss. This translates to a bandwidth of more than 50 percent. Isolation between the ports is symmetrical and greater than 20 dB across the frequency range.

For each dual slot antenna, the far field isolation between the cross-polarization and co-polarization may be approximately 20 dB or higher. The realized gain at 29 GHz for each port may be approximately 3.4 dB accounting for all losses (both impedance mismatch and radiation efficiency). The gain can be improved further with the presence of an EM shield as shown in relation to FIG. 12. The effect of the EM shield on the return loss bandwidth of the antenna is minimal and a performance of 50 percent bandwidth is maintained. The gain may be improved from 3.4 dB to 4.5 dB with the presence of the EM shield which acts as a reflector. Realized gain values across the 24 GHz to 41 GHz frequency range exhibit a gain flatness of 1.5 dB (from 4 dB to 5.5 dB) for, a gain bandwidth of more than 50 percent.

The example described above uses open slot antenna elements. However, the various other antenna types may be used in place of open slot antennas. For example, the antenna elements may be linear antenna types, such as dipoles, biconical antennas, and antipodal antennas, or traveling wave antenna types, such as tapered slots, Vivaldi antennas, bowtie antennas, or any antenna type that has symmetry about its excitation source. Accordingly, it will be appreciated that the two-port bowtie antenna shown in FIGS. 9 and 10 can also be constructed using the fabrication techniques described in relation to FIGS. 10, 11A, and 11B. Likewise, the two-port open slot antenna shown in FIGS. 10, 11A, and 11B can also be constructed using the fabrication techniques described in relation to FIGS. 9A and 9B.

Figure 12:
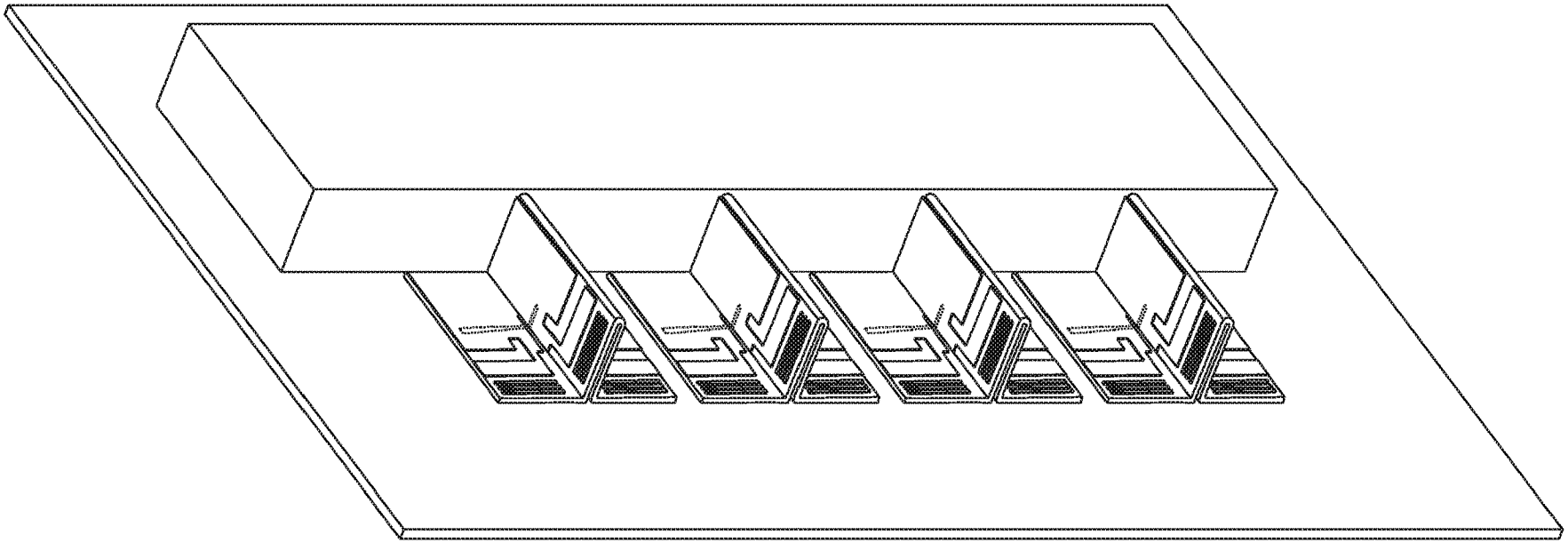
FIG. 12 is a perspective view of an antenna system with multiple perpendicular end-fire antennas.

FIG. 12 is a perspective view of an antenna system with multiple perpendicular end-fire antennas. The antenna system 1200 includes perpendicular end-fire antennas 1202, which may be any of the patch antennas describe above in relation to FIGS. 9-10. Additionally, the patch antennas may be dual polarized, horizontally polarized, vertically polarized or a combination thereof.

Each perpendicular end-fire antenna 1202 can be configured to cover multiple frequency ranges, including the LB (24 GHz to 33 GHz) and HB (37 GHz-43 GHz) frequency ranges for Enhanced Data rates for GSM Evolution (EDGE). The antennas may be configure as a MIMO antenna system and/or one or more phase arrays.

The patch antennas are disposed on a PCB 102 with feedlines coupling the patch antennas to respective RF transmitter and receiver circuits. The transmitter and receiver circuits may be enclosed with an EM shield 1204 along with various additional electronic components disposed on the PCB 102. The EM shield 1204 can be positioned to improve the effective gain of the perpendicular end-fire antennas 1202. In some embodiments, the spacing, S, between the EM shield and the perpendicular end-fire antennas 1202 may be approximately 0.5 mm.

Figure 13:
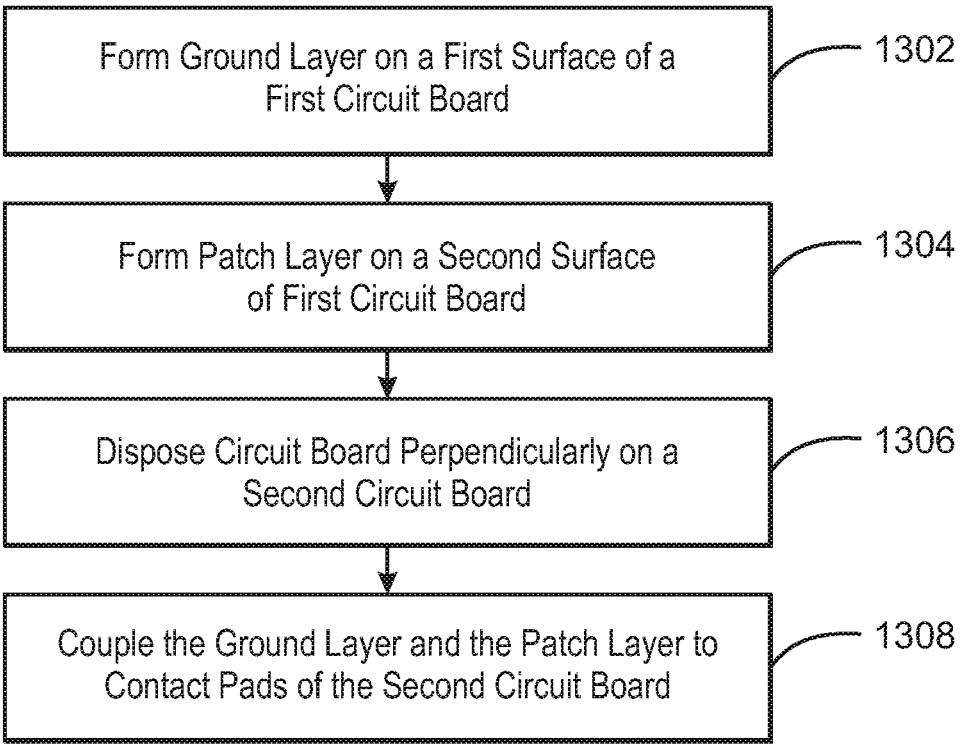
FIG. 13 is a process flow diagram of an example method to fabricate an end-fire antenna.

FIG. 13 is a process flow diagram of an example method to fabricate an end-fire antenna. The method 1300 may be used to fabricate any one of the antenna described in relation to FIGS. 1-7.

At block 1302, a ground layer is formed on a first surface of a first circuit board. At block 1304, a patch layer is formed on a second surface of the first circuit board. The ground layer and patch layer may be formed using any suitable technique for fabricating structures in printed circuit boards, such as depositing metal layers and traces, forming vias, and the like.

At block 1306, the first circuit board is disposed perpendicularly on the second circuit board. For example, the first circuit board may be cut and then flipped ninety degrees compared to the second circuit board.

At block 1308, the ground layer and the patch layer are coupled to contact pads of the second circuit board through ball grid array (BGA) surface mounting.

The method 1300 should not be interpreted as meaning that the blocks are necessarily performed in the order shown. Furthermore, fewer or greater actions can be included in the method 1300 depending on the design considerations of a particular implementation.

Figure 14:
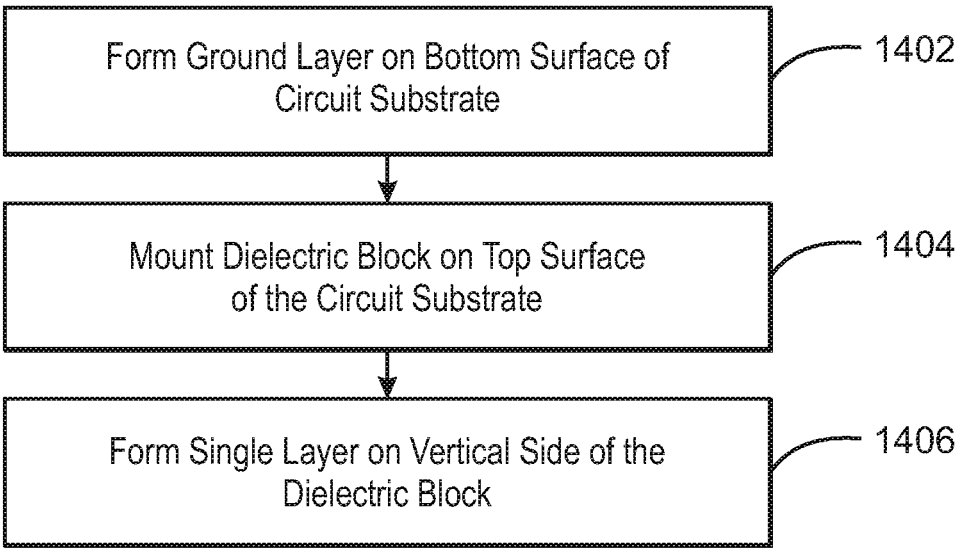
FIG. 14 is a process flow diagram of an example method to fabricate an end-fire antenna.

FIG. 14 is a process flow diagram of an example method to fabricate an end-fire antenna. The method 1400 may be used to fabricate any of the antennas described in relation to FIGS. 9A and 9B.

At block 1402, a ground layer is formed on a bottom surface of a circuit substrate. At block 1404, a dielectric block is mounted on a top surface of the circuit substrate. At block 1406, a signal layer is formed on a vertical side of the dielectric block, so that the signal layer is perpendicular to the ground layer. The signal layer and ground layer may be shaped to form any suitable of antenna, including a log periodic bowtie, open slot antenna, and others.

The method 1400 should not be interpreted as meaning that the blocks are necessarily performed in the order shown. Furthermore, fewer or greater actions can be included in the method 1400 depending on the design considerations of a particular implementation.

Figure 15:
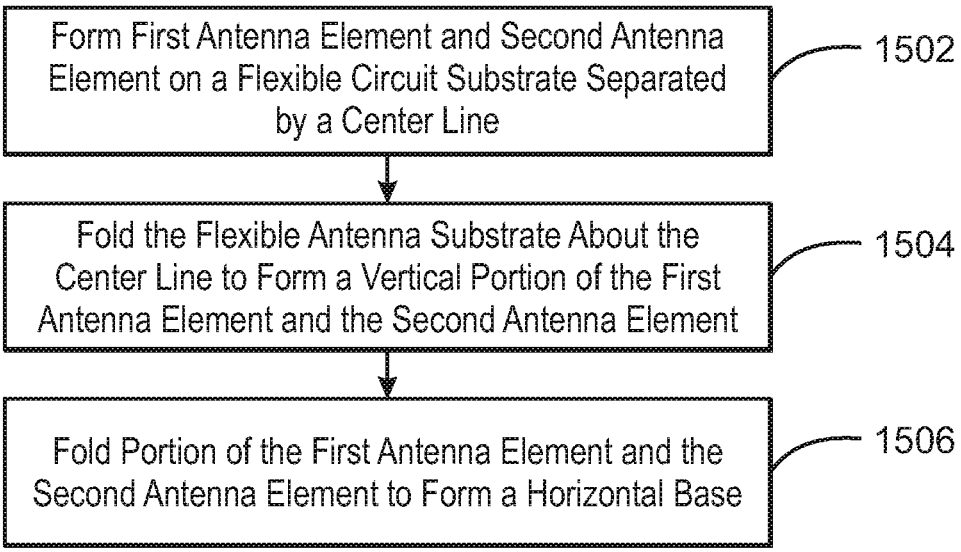
FIG. 15 is a process flow diagram of an example method to fabricate an end-fire antenna.

FIG. 15 is a process flow diagram of an example method to fabricate an end-fire antenna. The method 1500 may be used to fabricate any of the antennas described in relation to FIGS. 10-11.

At block 1502, antenna elements are formed on a flexible circuit substrate. The antenna elements can include a first antenna element and second antenna separated by a enter line. In some examples, the second antenna element is a mirror image of the first antenna element about the center line. The antenna elements may be shaped to form any suitable type of antenna, including a log periodic bowtie, open slot antenna, and others.

At block 1504, the flexible antenna substrate is folded about the center line to form a vertical portion of the first antenna element and the second antenna element. The flexible antenna substrate may be folded approximately 180 degrees or less. In some examples, the antenna substrate may be folded at to an angle of 120 degrees, 135 degrees, etc.

At block 1506, a portion of the first antenna element and the second antenna element to form a horizontal base. For example, each antenna element may be folded at approximately its center. The fold angle for each antenna element may be one half of the fold angle between the two antenna elements and in the opposite direction.

The method 1500 should not be interpreted as meaning that the blocks are necessarily performed in the order shown. Furthermore, fewer or greater actions can be included in the method 1500 depending on the design considerations of a particular implementation.

EXAMPLES

Example 1 is a hand-held mobile electronic device with an end-fire antenna. The electronic device includes a housing of the mobile electronic device, and a first circuit board including electronic components of the mobile electronic device. The first circuit board is parallel with a major plane of the housing. The electronic device also includes an antenna coupled to the first circuit board. At least a portion of the antenna is oriented perpendicular to the first circuit board to generate a radiation pattern with an amplitude that is greater in an end-fire direction compared to a broadside direction.

Example 2 includes the electronic device of example 1, including or excluding optional features. In this example, the antenna includes a patch antenna which includes a ground layer oriented perpendicular to the first circuit board, and a patch element oriented perpendicular to the first circuit board. Optionally, the ground layer includes a ground layer surface portion and a ground layer embedded portion and the patch element includes a patch element surface portion a patch element embedded portion. Optionally, the ground layer and the patch element are formed in a second circuit board and mounted to the first circuit board using ball grid array (BGA) surface mounting.

Example 3 includes the electronic device of any one of examples 1 to 2, including or excluding optional features. In this example, the antenna includes a ground layer disposed on a bottom surface of the first circuit board, and a signal portion disposed on a vertical substrate coupled to a top surface of the first circuit board.

Example 4 includes the electronic device of any one of examples 1 to 3, including or excluding optional features. In this example, the antenna includes a first antenna element and a second antenna element disposed on a flexible circuit substrate and folded about a center line between the first antenna element and a second antenna element. Each of the first antenna element and the second antenna element includes a vertical portion and a horizontal portion.

Example 5 includes the electronic device of any one of examples 1 to 4, including or excluding optional features. In this example, the antenna includes a first log periodic bowtie antenna and a second periodic bowtie antenna arranged in a mirror configuration with the first log periodic bowtie antenna.

Example 6 includes the electronic device of any one of examples 1 to 5, including or excluding optional features. In this example, the antenna includes a first open slot antenna and a second open slot antenna arranged in a mirror configuration with the first open slot antenna.

Example 7 includes the electronic device of any one of examples 1 to 6, including or excluding optional features. In this example, the antenna includes a first antenna element configured to generate a first polarization and a second antenna element configured to generate a second polarization orthogonal to the first polarization. The first polarization and the second polarization are both oriented at approximately 45 degrees to the plane of the first circuit board, and the first polarization and the second polarization are both in the plane of the main beam of propagation.

Example 8 includes the electronic device of any one of examples 1 to 7, including or excluding optional features. In this example, the antenna is configured to operate across a frequency range of 24 GHz to 43 GHz.

Example 9 is a method of fabricating an end-fire antenna. The method includes forming a ground layer on a first surface of a first circuit board; forming a patch layer on a second surface of the first circuit board; disposing the first circuit board perpendicularly on a second circuit board; and coupling the ground layer and the patch layer to contact pads of the second circuit board through ball grid array (BGA) surface mounting.

Example 10 includes the method of example 9, including or excluding optional features. In this example, the patch layer is formed in an internal surface of the first circuit board, and the method included forming a parasitic layer on a third surface of the circuit board.

Example 11 includes the method of any one of examples 9 to 10, including or excluding optional features. In this example, the method includes forming a conductive via that couples the patch layer to the first surface of the circuit board, at a portion of the first surface that is surrounded by a void in the ground layer.

Example 12 includes the method of any one of examples 9 to 11, including or excluding optional features. In this example, the method includes coupling a first feed structure to a horizontal side of the patch layer, and coupling a second feed structure to a vertical side of the patch layer. The first feed structure is to provide a first polarization and the second feed structure is to provide a second polarization.

Example 13 is a method of fabricating an end-fire antenna. The method includes forming a ground layer on a bottom surface of a circuit substrate; mounting a dielectric block on a top surface of the circuit substrate; and forming a signal layer on a vertical side of the dielectric block, wherein the signal layer is perpendicular to the ground layer.

Example 14 includes the method of example 13, including or excluding optional features. In this example, the signal layer is formed through edge plating.

Example 15 includes the method of any one of examples 13 to 14, including or excluding optional features. In this example, the ground layer includes a first ground element and a second ground element arranged in a mirror configuration with the first ground element. Additionally, the signal layer includes a first signal element on a first vertical side of the dielectric block and a second signal element on a second vertical side of the dielectric block. The first ground element and the first signal element form a first antenna element, and the second ground element and the second signal element form a second antenna element.

Example 16 includes the method of any one of examples 13 to 15, including or excluding optional features. In this example, the first antenna element includes a first log periodic bowtie antenna, and the second antenna element includes a second periodic bowtie antenna arranged in a mirror configuration with the first log periodic bowtie antenna.

Example 17 includes the method of any one of examples 13 to 16, including or excluding optional features. In this example, the first antenna element includes a first open slot antenna, and the second antenna element includes a second open slot antenna arranged in a mirror configuration with the first open slot antenna.

Example 18 includes the method of any one of examples 13 to 17, including or excluding optional features. In this example, the method includes coupling a first feed line to the first antenna element to feed a first polarization, and coupling a second feed line to the second antenna element to feed a second polarization.

Example 19 is a method of fabricating an end-fire antenna. The method includes forming a first antenna element on a flexible circuit substrate, and forming a second antenna element on the flexible circuit substrate. The second antenna element is a mirror image of the first antenna element about a center line separating the first antenna element and second antenna element. The method also includes folding the flexible antenna substrate about the center line to form a vertical portion of the first antenna element and the second antenna element, and folding a portion of the first antenna element and the second antenna element to form a horizontal base.

Example 20 includes the method of example 19, including or excluding optional features. In this example, the first antenna element includes a first open slot antenna and the second antenna element includes a second open slot antenna.

Example 21 includes the method of any one of examples 19 to 20, including or excluding optional features. In this example, the method includes forming a first feed line on a bottom surface of the flexible circuit substrate to feed the first antenna element and forming a second feed line on a bottom surface of the flexible circuit substrate to feed the second antenna element.

Example 22 includes the method of any one of examples 19 to 21, including or excluding optional features. In this example, the first antenna element is configured to generate a first polarization, and the second antenna element is configured to generate a second polarization orthogonal to the first polarization. Optionally, the first polarization and the second polarization are both oriented at approximately 45 degrees to the plane of the horizontal base.

Example 23 is an end-fire antenna for a handheld mobile device. The antenna includes a ground layer disposed on a first surface of a first circuit board, and a patch layer disposed on a second surface of the first circuit board. The first circuit board is disposed perpendicularly on a second circuit board including electronic components of the mobile electronic device. The second circuit board is parallel with a major plane of the mobile device.

Example 24 includes the antenna of example 23, including or excluding optional features. In this example, the ground layer and the patch layer are coupled to contact pads of the second circuit board through ball grid array (BGA) surface mounting.

Example 25 includes the antenna of any one of examples 23 to 24, including or excluding optional features. In this example, the device includes a parasitic layer disposed on a third surface of the circuit board, wherein the patch layer is disposed on an internal surface of the first circuit board.

Example 26 includes the antenna of any one of examples 23 to 25, including or excluding optional features. In this example, the device includes conductive via that couples the patch layer to the first surface of the circuit board, at a portion of the first surface that is surrounded by a void in the ground layer.

Example 27 includes the antenna of any one of examples 23 to 26, including or excluding optional features. In this example, the device includes a first feed structure coupled to a horizontal side of the patch layer, and a second feed structure coupled to a vertical side of the patch layer. The first feed structure is to provide a first polarization and the second feed structure is to provide a second polarization.

Example 28 includes the antenna of any one of examples 23 to 27, including or excluding optional features. In this example, a portion of the ground layer and a portion of the patch layer are both embedded in the second circuit board. Optionally, the portion of the ground layer and the portion of the patch layer embedded in the second circuit board both include a mesh of vias and signal traces.

Example 29 includes the antenna of any one of examples 23 to 28, including or excluding optional features. In this example, the antenna is configured to operate across a frequency range of 24 GHz to 43 GHz.

Example 30 is an end-fire antenna for a handheld mobile device. The antenna includes a ground layer disposed on a bottom surface of a circuit substrate, a dielectric block disposed on a top surface of the circuit substrate, and a signal layer disposed on a vertical side of the dielectric block. The signal layer is perpendicular to the ground layer.

Example 31 includes the antenna of example 30, including or excluding optional features. In this example, the signal layer is formed through edge plating.

Example 32 includes the antenna of any one of examples 30 to 31, including or excluding optional features. In this example, the ground layer includes a first ground element a second ground element arranged in a mirror configuration with the first ground element. Additionally, the signal layer includes a first signal element on a first vertical side of the dielectric block and a second signal element on a second vertical side of the dielectric block. The first ground element and the first signal element form a first antenna element, and the second ground element and the second signal element form a second antenna element.

Example 33 includes the antenna of any one of examples 30 to 32, including or excluding optional features. In this example, the first antenna element includes a first log periodic bowtie antenna and the second antenna element includes a second periodic bowtie antenna arranged in a mirror configuration with the first log periodic bowtie antenna.

Example 34 includes the antenna of any one of examples 30 to 33, including or excluding optional features. In this example, the first antenna element includes a first open slot antenna and the second antenna element includes a second open slot antenna arranged in a mirror configuration with the first open slot antenna.

Example 35 includes the antenna of any one of examples 30 to 34, including or excluding optional features. In this example, the antenna includes a first feed line coupled to the first antenna element to feed a first polarization, and a second feed line coupled to the second antenna element to feed a second polarization. Optionally, the first polarization and the second polarization are both oriented at approximately 45 degrees to the plane of the first circuit board, and wherein the first polarization and the second polarization are both in the plane of the main beam of propagation.

Example 36 includes the antenna of any one of examples 30 to 35, including or excluding optional features. In this example, the antenna is configured to operate across a frequency range of 24 GHz to 43 GHz.

Example 37 is an end-fire antenna for a handheld mobile device. The antenna includes a first antenna element disposed on a flexible circuit substrate, and a second antenna element disposed on the flexible circuit substrate. The second antenna element is a mirror image of the first antenna element about a center line separating the first antenna element and second antenna element. The flexible antenna substrate is folded about the center line to form a vertical portion of the first antenna element and the second antenna element. Additionally, a portion of the first antenna element and the second antenna element is folded to form a horizontal base.

Example 38 includes the antenna of example 37, including or excluding optional features. In this example, the first antenna element includes a first open slot antenna and the second antenna element includes a second open slot antenna.

Example 39 includes the antenna of any one of examples 37 to 38, including or excluding optional features. In this example, the first antenna element includes a first log periodic bowtie antenna and the second antenna element includes a second periodic bowtie antenna arranged in a mirror configuration with the first log periodic bowtie antenna.

Example 40 includes the antenna of any one of examples 37 to 39, including or excluding optional features. In this example, the device includes a first feed line on a bottom surface of the flexible circuit substrate to feed the first antenna element, and a second feed line on the bottom surface of the flexible circuit substrate to feed the second antenna element.

Example 41 includes the antenna of any one of examples 37 to 40, including or excluding optional features. In this example, the first antenna element is configured to generate a first polarization, and the second antenna element is configured to generate a second polarization orthogonal to the first polarization. Optionally, the first polarization and the second polarization are both oriented at approximately 45 degrees to the plane of the horizontal base.

Example 42 includes the antenna of any one of examples 37 to 41, including or excluding optional features. In this example, the antenna is configured to operate across a frequency range of 24 GHz to 43 GHz.

Some embodiments may be implemented in one or a combination of hardware, firmware, and software. Some embodiments may also be implemented as instructions stored on the tangible non-transitory machine-readable medium, which may be read and executed by a computing platform to perform the operations described. In addition, a machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the computing device described above may also be implemented with respect to either of the methods or the computer-readable medium described herein. Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. A hand-held mobile electronic device with an end-fire antenna, comprising:

a housing of the mobile electronic device;

a first circuit board comprising electronic components of the mobile electronic device, wherein the first circuit board is parallel with a major plane of the housing;

an antenna coupled to the first circuit board, wherein at least a portion of the antenna is oriented perpendicular to the first circuit board to generate a radiation pattern with an amplitude that is greater in an end-fire direction compared to a broadside direction.

2. The hand-held mobile electronic device of claim 1, wherein the antenna comprises a patch antenna comprising:

a ground layer oriented perpendicular to the first circuit board; and a patch element oriented perpendicular to the first circuit board.

3. The hand-held mobile electronic device of claim 2, wherein the ground layer comprises a ground layer surface portion and a ground layer embedded portion and the patch element comprises a patch element surface portion a patch element embedded portion.

4. The hand-held mobile electronic device of claim 2, wherein the ground layer and the patch element are formed in a second circuit board and mounted to the first circuit board using ball grid array (BGA) surface mounting.

5. The hand-held mobile electronic device of claim 1, wherein the antenna comprises:

a ground layer disposed on a bottom surface of the first circuit board; and a signal portion disposed on a vertical substrate coupled to a top surface of the first circuit board.

6. The hand-held mobile electronic device of claim 1, wherein the antenna comprises a first antenna element and a second antenna element disposed on a flexible circuit substrate and folded about a center line between the first antenna element and a second antenna element, wherein each of the first antenna element and the second antenna element comprises a vertical portion and a horizontal portion.

7. The hand-held mobile electronic device of claim 1, wherein the antenna comprises a first log periodic bowtie antenna and a second periodic bowtie antenna arranged in a mirror configuration with the first log periodic bowtie antenna.

8. The hand-held mobile electronic device of claim 1, wherein the antenna comprises a first open slot antenna and a second open slot antenna arranged in a mirror configuration with the first open slot antenna.

9. The hand-held mobile electronic device of claim 1, wherein the antenna comprises a first antenna element configured to generate a first polarization and a second antenna element configured to generate a second polarization orthogonal to the first polarization, wherein the first polarization and the second polarization are both oriented at approximately 45 degrees to the plane of the first circuit board, and wherein the first polarization and the second polarization are both in the plane of the main beam of propagation.

10. The hand-held mobile electronic device of claim 1, wherein the antenna is configured to operate across a frequency range of 24 GHz to 43 GHz.

* * * * *